US008069992B2

(12) United States Patent
Rosen et al.

(10) Patent No.: US 8,069,992 B2
(45) Date of Patent: Dec. 6, 2011

(54) ANGLED PACKAGE AND DISPLAY SYSTEM

(75) Inventors: Ian K. Rosen, North Muskegon, MI (US); Chad A. Des Jardin, Spring Lake, MI (US)

(73) Assignee: AGS I-Prop, LLC, Muskegon, MI (US)

( * ) Notice: Subject to any disclaimer, the term of this patent is extended or adjusted under 35 U.S.C. 154(b) by 0 days.

(21) Appl. No.: 13/014,911

(22) Filed: Jan. 27, 2011

(65) Prior Publication Data

US 2011/0120963 A1 May 26, 2011

Related U.S. Application Data

(60) Division of application No. 11/876,327, filed on Oct. 22, 2007, now Pat. No. 7,918,352, which is a continuation-in-part of application No. 11/690,486, filed on Mar. 23, 2007, now Pat. No. 7,520,394, which is a continuation of application No. 10/962,154, filed on Oct. 7, 2004, now Pat. No. 7,204,373.

(60) Provisional application No. 60/521,332, filed on Apr. 2, 2004.

(51) Int. Cl.
*A47F 5/08* (2006.01)

(52) U.S. Cl. ..... 211/57.1; 211/73

(58) Field of Classification Search ..... 211/72, 211/73, 113, 118, 119.003, 183, 57.1, 59.1, 211/59.2, 52, 55; 206/762, 764, 765, 4, 461, 206/705, 471, 806

See application file for complete search history.

(56) References Cited

U.S. PATENT DOCUMENTS

| | | | |
|---|---|---|---|
| 0,781,766 | A | 2/1905 | Cawthray |
| 0,952,302 | A | 3/1910 | Brenner |
| 1,189,531 | A | 7/1916 | Bierwirth |
| 2,070,747 | A | 2/1937 | Orstrom |
| 2,294,641 | A | 9/1942 | Walters |
| 3,326,361 | A | 6/1967 | Zimmerman |
| 3,630,251 | A | 12/1971 | Ross |
| 4,497,464 | A | 2/1985 | Fast |
| 4,503,116 | A | 3/1985 | Lapidus |
| 4,579,232 | A | 4/1986 | Fedak |
| 4,693,441 | A | 9/1987 | Conway |
| 4,796,761 | A | 1/1989 | Hermelin |
| 4,801,023 | A | 1/1989 | Ecclestone |
| 4,832,301 | A | 5/1989 | Hiramoto et al. |
| 4,944,412 | A | 7/1990 | Daigre |
| 4,962,859 | A | 10/1990 | Kump |
| 5,083,663 | A | 1/1992 | Conway et al. |
| 5,123,545 | A | 6/1992 | Hickman |
| 5,143,215 | A | 9/1992 | Hartley et al. |
| 5,161,699 | A | 11/1992 | Hanna et al. |
| 5,257,734 | A | 11/1993 | Bartle |

(Continued)

*Primary Examiner* — Jennifer E. Novosad
(74) *Attorney, Agent, or Firm* — Gardner, Linn, Burkhart & Flory, LLP

(57) ABSTRACT

A product display system and method includes a support and at least one product container supported by the support. The product containers incorporate one or more wings or flanges that enhance viewability of the containers from the side. The wings of the product containers may project forwardly or rearwardly from card portions of the containers, such as at angles of at least 20 degrees relative to the card portions. The containers may be supported at a support arm or the like, and have a center of gravity located behind a header for suspending the packages from the support arm, causing the packages to angle or tilt with their front faces angled somewhat upwardly, such as toward an illumination source, when suspended from the support arm.

20 Claims, 6 Drawing Sheets

U.S. PATENT DOCUMENTS 5,269,408 A 12/1993 Otis et al.
5,344,004 A 9/1994 Meyer
5,423,436 A 6/1995 Morrow
5,542,551 A 8/1996 Smith
5,620,103 A 4/1997 Vlah et al.
5,720,428 A 2/1998 Jensen
5,899,329 A 5/1999 Hu et al.
5,915,571 A 6/1999 Czalkiewicz et al.
6,186,343 B1 2/2001 Brown
6,227,384 B1 5/2001 Saylor et al.
6,283,312 B1 9/2001 Edgerton
6,612,483 B2 9/2003 Harris et al.
6,739,453 B1 5/2004 Mazurek
6,769,541 B1 8/2004 Carriere
6,805,249 B1 10/2004 Houle
6,948,625 B2 9/2005 Keberlein
6,955,268 B2 10/2005 Waldron
7,204,373 B2 4/2007 Rosen
7,413,075 B2 8/2008 David et al.
7,520,394 B2 4/2009 Rosen
2006/0237380 A1 10/2006 Rosen
2008/0093431 A1 4/2008 Rosen

ANGLED PACKAGE AND DISPLAY SYSTEM

CROSS REFERENCE TO RELATED APPLICATIONS

The present application is a divisional of U.S. patent application Ser. No. 11/876,327, filed Oct. 22, 2007, now U.S. Pat. No. 7,918,352, which is a continuation-in-part of U.S. patent application Ser. No. 11/690,486, filed Mar. 23, 2007, now U.S. Pat. No. 7,520,394, which is a continuation of U.S. patent application Ser. No. 10/962,154, filed Oct. 7, 2004, now U.S. Pat. No. 7,204,373, which claims the benefit of U.S. provisional application, Ser. No. 60/521,332, filed Apr. 2, 2004, which are hereby incorporated herein by reference in their entireties.

FIELD OF THE INVENTION

The present invention relates generally to containers or packages or boxes for products, such as toothbrushes, pens, playing cards, camera film, batteries, small toys, and the like, and, more particularly, to containers or packages or boxes of such products suspended from a peg for viewing and purchasing by a customer at a grocery store or the like.

BACKGROUND OF THE INVENTION

Packaged goods, such as are typically packaged in rectangular boxes or "bubble" or "blister" packages, are typically placed on generally horizontal pegs or display racks or rods within a grocery store or the like, such as self-service retail stores or the like. Typical products in such packages on the shelves in retail stores contain or include, for example, toothbrushes, pens, playing cards, camera film, batteries, small toys, or the like. Typically, these packages are suspended from the display racks in rows and are placed adjacent to other choices or brands of similar products. The boxes or packages include facings with text and graphics or the like to communicate to the shoppers what is in the boxes and any other information about the products in the boxes. The boxes or packages of similar products are typically generally the same shape, and seek to achieve distinction in the selection process of the consumer through various characteristics, such as brand identification, special product offers or other offers on the package, color attraction, value of benefits and the like, that are visible or viewable at the product package and that may encourage the shopper to select one brand of product over another. Suspended goods are often supported at their back panels such that their front panels or faces are angled somewhat downward when they are suspended.

As the consumer patrols the aisles of the store for their groceries or other items, the consumer will look at the products along the shelves of the aisles and select a desired product or often a product that catches his or her attention better than other products in that aisle. Because such products are often purchased on impulse, and with little prior thought or planning on the part of the consumer, it is often desired to distinguish the packages from one another to improve the chance that a consumer will notice and select a particular package over the others on the display racks. Any competitive advantage or enhancement to the appearance or distinction from one product to another may significantly increase the likelihood that a consumer will select the enhanced or distinct product package over the other products and packages on the display racks.

Therefore, there is a need in the art for a package that will have enhanced visual appeal to further distinguish it from the other packages at the display rack or panel.

SUMMARY OF THE INVENTION

The present invention provides an angled or tilted container, such as a box or bubble package or blister package or other type of container or package, that is supported at a location relative to the center of gravity of the package to lift or support or raise the front portion of the container upward and, thus, tilt the container rearward to enhance the viewability and appearance of the front face of the container to a consumer walking down the aisle of a store along or adjacent to racks or panels containing such containers or packages. Because the containers may be tilted to direct the front face of the container at least partially upward, the containers or packages of the present invention are better illuminated by the overhead lighting in the store and, thus, are further enhanced and distinguished from the other generally vertically oriented containers or packages on the shelves. This is because the viewing angle of the tilted containers at shelves or supports below eye level is adjusted to be close to 90 degrees by the angling of the containers upward and toward the eye level of the consumers.

Optionally, the packages or containers of the present invention may comprise hanging packages that are suspended from a support arm, such as via insertion of the support arm through an aperture in a header portion of the package, where the packages and products contained therein have a combined center of gravity located behind the aperture header portion when the packages are oriented vertically. The packages are supported in a tilted or non-vertical manner such that front surfaces of the packages are angled upwardly when the packages are suspended by the header portion at the aperture, with the front face of the package facing partially upward to enhance viewing of the package.

According to another aspect of the present invention, a method of displaying product packages at a store includes providing at least one generally horizontal support and providing at least one illumination source substantially above the support and operable to illuminate the support. A plurality of product packages is positioned on the support. The packages are tilted rearwardly with the front walls or faces of the front row of packages facing at least partially upward toward the illumination source to provide enhanced illumination of the front walls of the packages.

Therefore, the present invention provides an angled package or box or container and a system and method for displaying such packages or boxes or containers. The containers may be tilted to provide enhanced viewing of the front wall or face of the containers. The tilted containers may be nested together on a peg or a rack to minimize the space required for the containers while still providing the enhanced viewability of the containers. The containers may also incorporate wings or flanges that enhance viewability of the containers from the side. Because the containers may be angled to be directed generally upwardly toward a light illumination source in the store, the face of the containers may be at a more "viewer friendly" angle and may be better illuminated than the faces of conventional, generally perpendicular packages or containers, and thus may provide brighter colors and graphics to enhance the distinction of the product package relative to the other packages or boxes or containers on the racks.

These and other objects, advantages, purposes and features of the present invention will become apparent upon review of the following specification in conjunction with the drawings.

DESCRIPTION OF THE PREFERRED EMBODIMENTS

Figure 1:
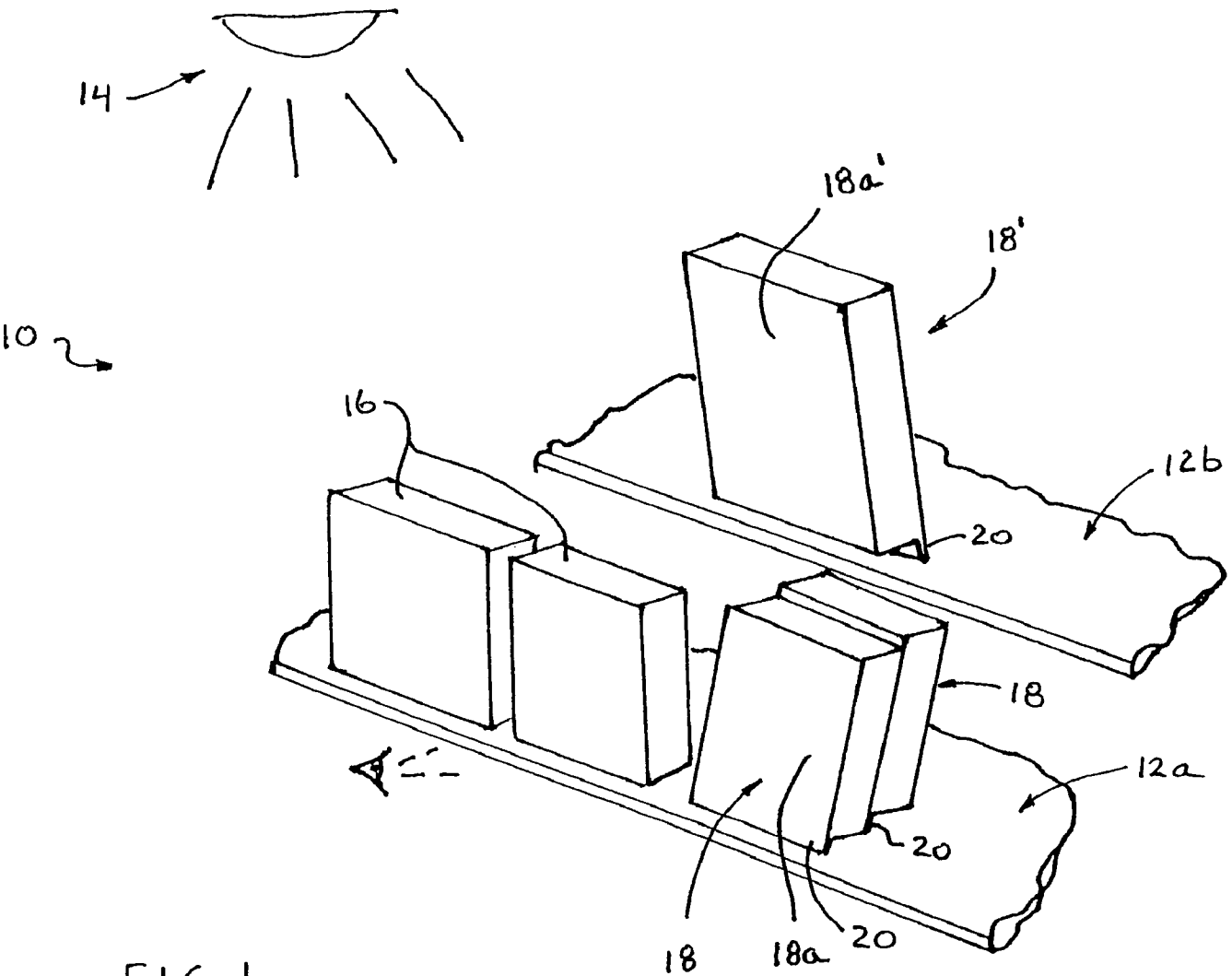
FIG. 1 is a perspective view of a product display system in accordance with the present invention.

Referring now to the drawings and the illustrative embodiments depicted therein, a product display system 10 includes a plurality of supports or shelves 12*a*, 12*b* extending generally horizontally and along an aisle or walkway in a store or retail establishment or the like (FIG. 1). The product display system 10 includes an illumination source or light or overhead lighting device 14 positioned above the shelves, such as at the ceiling or the like of the store. Illumination source 14 is operable to direct illumination generally downwardly to illuminate the shelves and the products and packages positioned thereon. The shelves may support a plurality of conventional rectangular boxes 16 and a plurality of angulated or tilted boxes or containers 18. Angulated boxes 18 are supported on the shelves and may be tilted generally rearwardly, such that a forward face 18*a* of the box 18 is directed generally outwardly from the shelf and partially upwardly and partially toward the illumination source 14. Optionally, an angulated box 18' may be positioned on an upper support or shelf 12*b* and tilted such that a rearward face or wall 18*a'* of angulated box 18' is directed generally outwardly from the shelf and partially downwardly toward the eye level of a person below the shelf 12*b* and viewing the packages or boxes on the shelves. The boxes 18, 18' may be nested together on the shelves to minimize the space required for the boxes on the shelves. The boxes may comprise rectangular boxes or may comprise cylindrical containers or bottles or the like, while remaining within the spirit and scope of the present invention.

The angled or tilted containers of the present invention thus provide for enhanced viewing of the containers while taking up little or no additional space than is typically occupied by conventional containers. The present invention thus substantially distinguishes the containers of some products relative to other known or conventional containers, and thus enhances the likelihood that a consumer will select the enhanced or distinguished or distinct container over other containers positioned along the shelves or aisles of the store. Further, the present invention may utilize aspects of commonly assigned U.S. Pat. No. 7,204,373, U.S. patent application Ser. No. 11/690,486, filed Mar. 23, 2007, now U.S. Pat. No. 7,520,394, and U.S. patent application Ser. No. 11/472,001, filed Jun. 21, 2006, all of which are hereby incorporated herein by reference in their entireties.

As best shown in FIGS. 2A-6, it is further envisioned that aspects of the angled display system of the present invention may be applicable to packages or containers that hang from supports, such as arms or pegs or rods or the like, on a wall or panel or display rack in a store. Typically, such packages are in the form of cardboard cards or panels or the like with a header portion having a hole therethrough for receiving the peg or rod. The card thus hangs generally vertically or downward from the peg. A pegboard card of the present invention may include a spring-like or biasing extension or tab protruding or extending partially through or across the hole in the header portion of the card. The tab may engage the peg when the peg is inserted through the hole and may flex and brace against the peg or rod to cause tilting or angling of the package hanging from the peg or rod. For example, the tab may be positioned along a lower portion of the opening and may extend slightly rearwardly when the rod is received through the opening. The tab may push against the rod because the tab may be biased towards an initial position generally parallel to the card or header portion, such that the tab may cause an upward angling of the package or container to enhance viewability and reflectivity of the front surface of the container, in a similar manner as described above. Optionally, the tab and/or card may be reversed to cause a downward angling of the package to provide enhanced viewing of the package when it is positioned or hung above eye level.

Figure 2A:
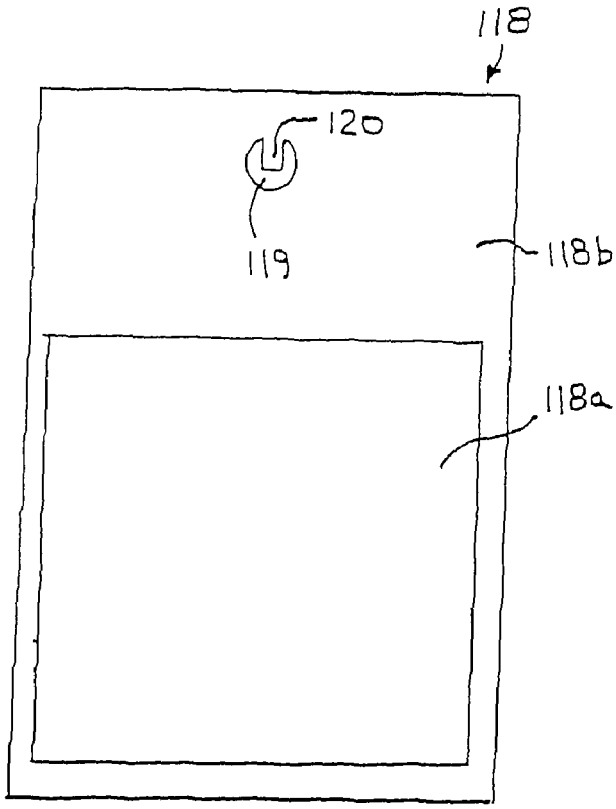
FIG. 2A is a front elevation of a hanging container with an angling tab in accordance with the present invention.
Figure 2B:
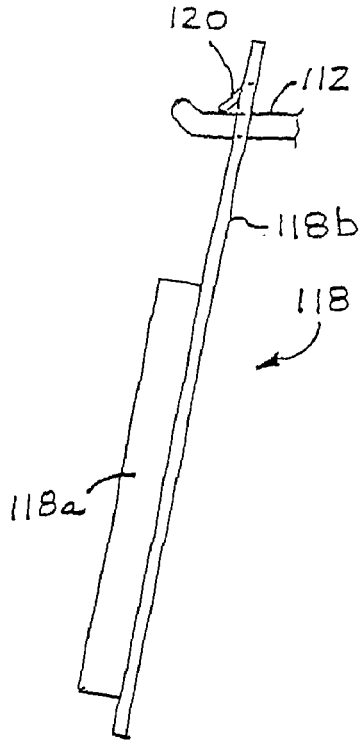
FIG. 2B is a side elevation of the hanging container of FIG. 2A.

For example, and with reference to FIG. 2A, a container 118 may include a product-containing portion or container portion or bubble or package 118*a* (that defines a chamber and may hold or contain a product therein, such as a tube of adhesive or other products typically packaged and sold in such bubble type containers) and a header portion 118*b* that has an aperture or hole or opening 119 therethrough. A tab or extension 120 may extend partially across the aperture 119 and may be biased toward a position generally along or parallel to the header portion 118*b*. When the container is displayed at a store, the aperture 119 receives a peg or rod or hook or support or projection 112 therethrough to hang the container at a desired location in the store. When the peg 112 is inserted through the aperture 119, the tab 120 may flex outwardly (as shown in FIG. 2B) and may be biased toward its position along the header. The biasing tab 120 thus may impart or exert a biasing force on the header portion and/or container to cause the container to pivot or angle upwardly (as can be seen in FIG. 2B) to provide enhanced viewability of the container relative to other known or conventional card packages.

Optionally, other product-containing means or elements for containing a product at a hanging card portion may be implemented while remaining within the spirit and scope of the present invention. For example, the product-containing portion may be a shrink-wrap film or stretch film cover or element that at least partially envelops or encompasses the card portion for containing the product at the back of the card portion. Optionally, for example, the product-containing portion may be a plastic bubble with side flanges that are stapled or glued or fastened to the back of the card portion of the container. Optionally, the container may be otherwise weighted behind the card portion to effectively shift the center of gravity of the package rearward so as to cause the package to tilt or angle upward when hung on a support peg or post or rod, without departing from the spirit and scope of the present invention.

Figure 2C:
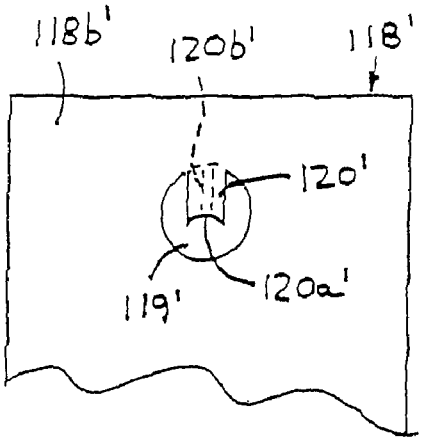
FIG. 2C is an enlarged view of another angling tab for a hanging container of the present invention.
Figure 2D:
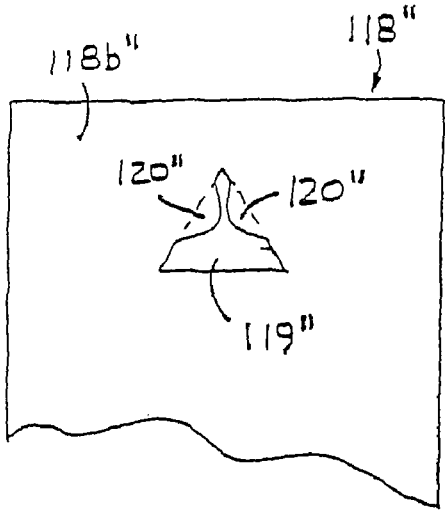
FIG. 2D is an enlarged view of another angling tab for a hanging container of the present invention.

As shown in FIG. 2C, a tab 120' extending partially across an aperture 119' of a header portion 118*b'* of a package or container 118' may include a curved lower end 120*a'* to generally correspond to the rounded shape of the peg or protrusion that is received through the aperture. The tab or tabs may include an indentation or corrugation or rib 120*b'* to enhance the strength or rigidity or biasing force of the tab, or the tab may include hinges or creases to allow for flexibility during mounting of the container on the peg. The aperture may comprise a generally circular aperture with a downward depending tab, or the aperture may have another shape, with one or more tabs protruding partially across the aperture and flexing and biasing the container toward the desired viewing angle. For example, and as shown in FIG. 2D, an aperture 119" of a header portion 118*b"* of a package or container 118" may be generally triangular-shaped, and a tab 120" may extend from two of the sides of the aperture to bias the container. Other sized and shaped tabs or skirts or the like may be implemented with other types of containers to provide for the enhanced viewability and reflectivity of the front or upper surfaces of product containers in the manner described above, without affecting the scope of the present invention.

Optionally, a package of the present invention may include a product-containing portion that positions a product substantially behind a front face of the product-containing portion. For example, a bubble-type package may have a bubble packet disposed at the rear side of the card portion of the package (the portion that extends upwardly to provide a header portion for suspending the package from a peg or support rod). Thus, the combined center of gravity (CG) of the package and its contents may be located behind the header portion of the package, such that the package may be tilted or canted upward when it is suspended from the header portion. For example, and with reference to FIGS. 3A-3C, a package or container 218 may include a product-containing portion or bubble or package portion 220 and a planar or card portion 222 with a header portion 224 that has an aperture or hole or opening 226 therethrough. When the container 218 is displayed at a store, the aperture 226 receives a peg or rod or hook or support or projection 212 therethrough to hang the container 218 at a desired location in the store. Projection 212 is attached to a vertical support surface 227 in a conventional manner.

In the illustrated embodiment, card portion 222 comprises a substantially planar sheet or substrate having package portion 220 attached thereto. Package portion 220 may be connected to card portion 222 via any suitable attachment means, such as, for example, with adhesive or fasteners, or by fitting a perimeter flange of the package between two adjacent card portions (not shown), or the like. Card portion 222 may incorporate header portion 224 at an upper end 222*a* of card portion 222 for the suspension of container 218 at projection 212. Alternatively, the header portion may be a separate element from the card portion, as will be described in greater detail below and with reference to FIG. 6. Card portion 222 may be made of cardboard, paperboard, paper, or plastic, for example, and may be made of a combination of materials. For example, card portion 222 may be made from a layer of paper sandwiched between two layers of transparent plastic, or from two layers of paperboard joined at their perimeter edges.

Figure 3A:
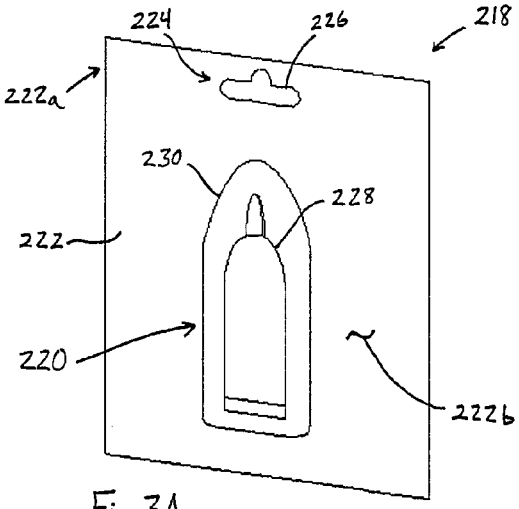
FIG. 3A is a perspective view of another hanging container of the present invention.
Figure 3B:
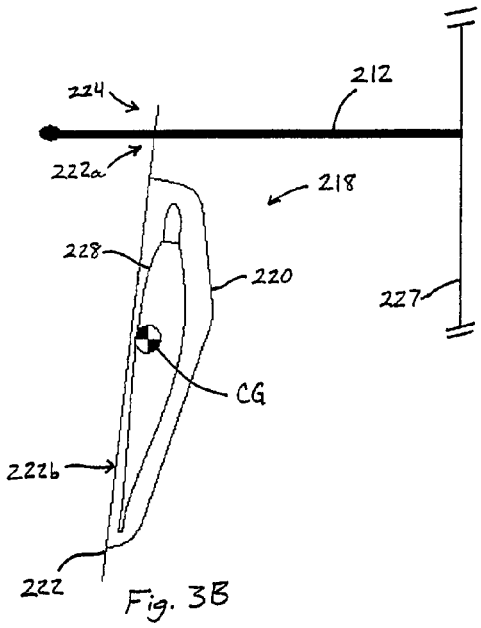
FIG. 3B is a side elevation of the hanging container of FIG. 3A positioned on a support arm.
Figure 3C:
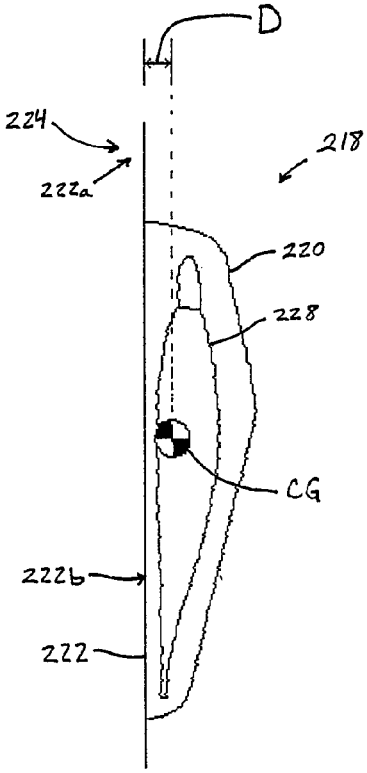
FIG. 3C is a side elevation of the hanging container of FIGS. 3A and 3B oriented substantially vertically.
Figure 4:
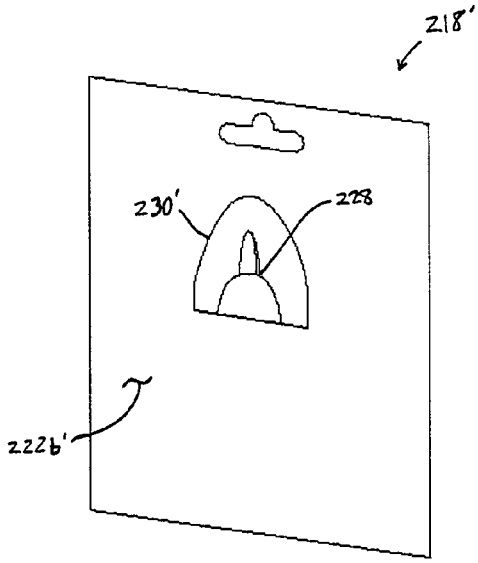
FIG. 4 is a perspective view of another hanging container of the present invention.

As with any suspended package or container, container 218 will rest at an orientation in which static equilibrium is achieved when container 218 is suspended from support 212 (FIG. 3B). Static equilibrium is achieved by container 218 when the center of gravity is located directly below the top of aperture 226 where support 212 contacts header portion 224. As best seen in FIG. 3C, the combined center of gravity of container 218 and a product 228 contained therein, is located a distance D behind a front face 222*b* of card portion 222. Thus, the placement of the center of gravity behind front face 222*b* of card portion 222 causes container 218 to tilt or angle so as to tilt or angle front face 222*b* upwardly when container 218 is suspended from support 212 at aperture 226. The upward angling of the package or container enhances viewability and reflectivity of the front surface of the container, especially in the presence of an illumination source, such as in a similar manner as described above.

Optionally, container 218 may include an aperture or window 230 through card 222 at front face 222*b*, through which all, or at least a portion, of the product 228 may be viewed. Optionally, a partial window 230' may be provided at front face 222*b'* of a container 218' (FIG. 4) through which less than the entire product 228 may be viewed from the front while permitting a view of the entire product from the back and providing a large amount of space on front face 222*b'* for graphics and/or product information. Alternatively, the front face may entirely lack an aperture or window for viewing the product such that the entire front face is available for graphics or labeling or the like, where the graphics may provide a graphic depiction of the product contained in the container.

Figure 5B:
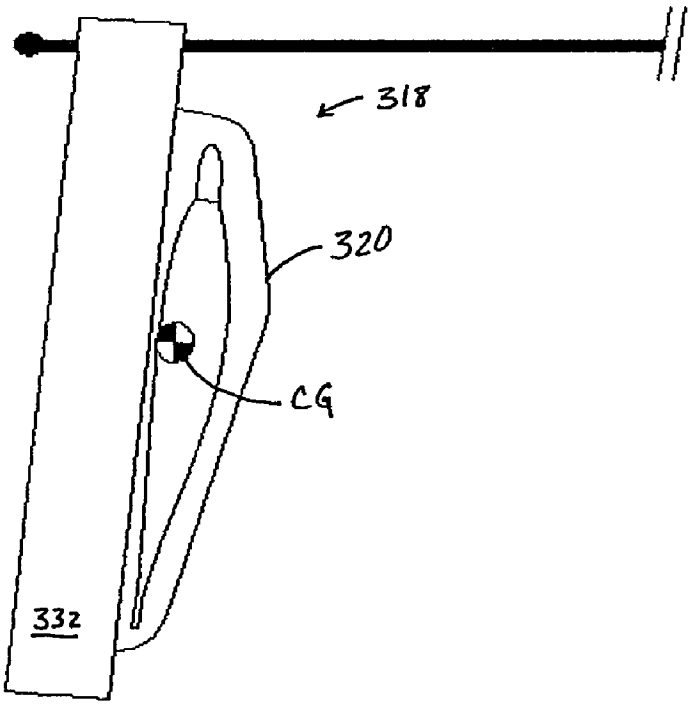
FIG. 5B is a side elevation of the hanging container of FIG. 5A positioned on a support arm.
Figure 5A:
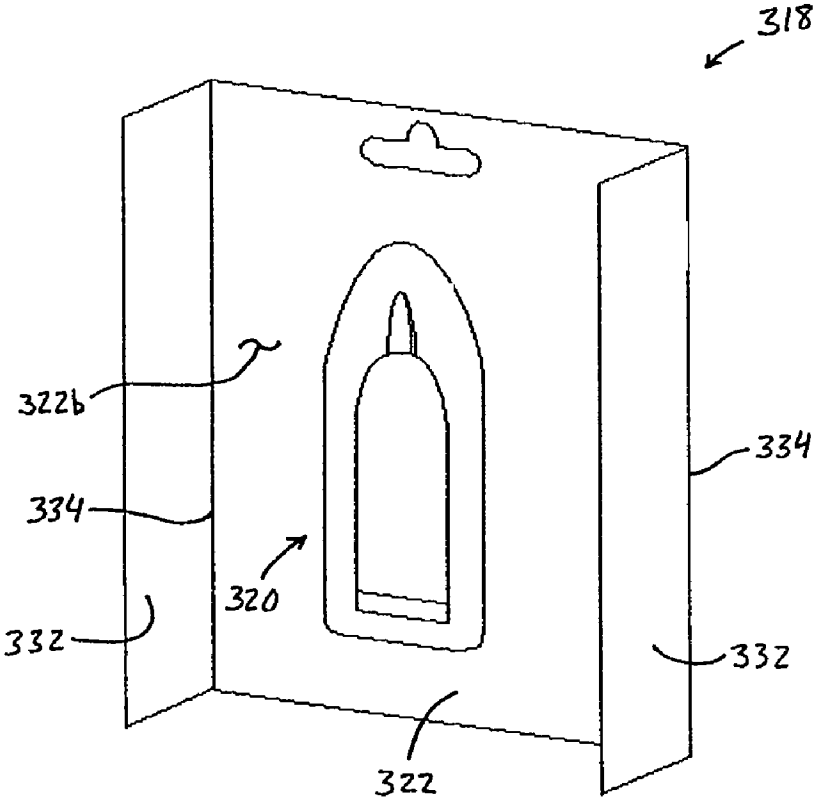
FIG. 5A is a perspective view of another hanging container of the present invention with a pair of side wings.

Optionally, and with reference to FIGS. 5A and 5B, a container 318 may include one or more extensions or wings 332 at a side edge or edges of a card 322 surrounding a product-containing portion 320. Wings 332 may comprise width extensions of card 322 in which the card 322 is folded at a desired or appropriate angle, such as, for example, about 90 degrees or thereabouts, to form angles or edges or corners 334 between wings 332 and a front face 322*b* of card 322. Optionally, the card may be folded at any other suitable angle, such as, for example, at an angle of about 20 degrees or more, such as an angle of about 45 degrees or thereabouts, so that the wings of one container do not contact an adjacent container, making the containers more space-efficient when supported on a support such as a rod while enhancing the viewability of the wings to a person viewing the package from an angle, such as from a location along an aisle of a store as the person approaches the hanging package or packages. Wings 332 may have reflective material or labeling or advertising printed thereon to further enhance the visibility or viewability of the container 318, especially when viewed from the side, such as by utilizing aspects of the display system described in commonly assigned U.S. patent application Ser. No. 12/172,446, filed Jul. 14, 2008, which claims the benefit of U.S. provisional application Ser. No. 60/950,188, filed Jul. 17, 2007, which are hereby incorporated herein by reference in their entireties. Wings 332 may also increase the rigidity of container 318 by resisting the flexion or bending of card 322 about a horizontal axis. Wings 332 are preferably made of the same material as card 322, and may be sufficiently light in weight so that they do not significantly affect the location of the center of gravity of container 318 or the tilt angle of container 318. It will be appreciated that although wings 332 project forward from front face 322*b* of card 322 in the illustrated embodiment, the wings may be configured to project backward from the front face of the card to move the location of the center of gravity of the container further rearward while permitting labeling or advertising thereon, and without shadowing front face 322*b* of card 322.

Figure 6:
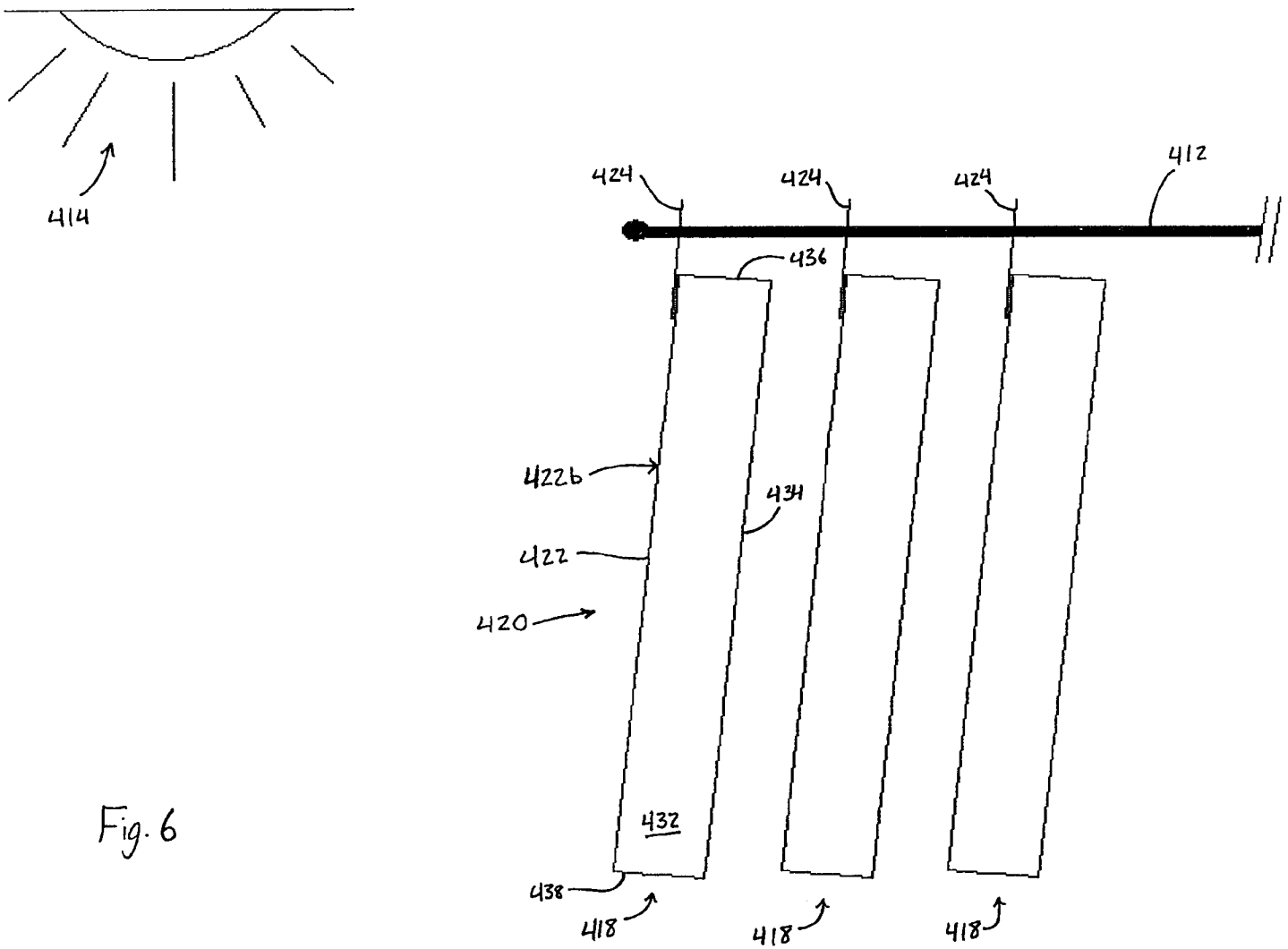
FIG. 6 is a side elevation of a plurality of containers in accordance with the present invention positioned on a support arm.

Optionally, and with reference to FIG. 6, a container 418 may be suspended from projection 412 at a separate header portion 424. Separate header portion 424 is affixed to container 418 such as at a front face 422*b* of a card portion 422, for example. Separate header portion 424 may be affixed to container 418 with glue, tape, a rivet, or similar fastening agent or device, and may be removable therefrom. Container 418 is primarily comprised of a package portion 420. Package portion 420 incorporates card portion 422 at its front, opposite side panels 432, a rear panel 434 opposite card portion 422, a top panel 436, and a bottom panel 438. Card portion 422 and panels 432, 434, 436, 438 are joined at their adjacent edges to form package portion 420 of container 418 as a box for containing a product therein. By supporting package portion 420 at separate header portion 424 at front face 422*b*, front face 422*b* is tilted upwardly in a similar manner as described above, and thus may provide enhanced reflection and illumination at the front face via an overhead illumination source 414, or the like. Such a configuration provides the upwardly-tilting benefits described herein, while optionally permitting a customer to remove separate header portion 424 after purchase and continue to use package portion 420 for storing the product, for example.

Figure 7A:
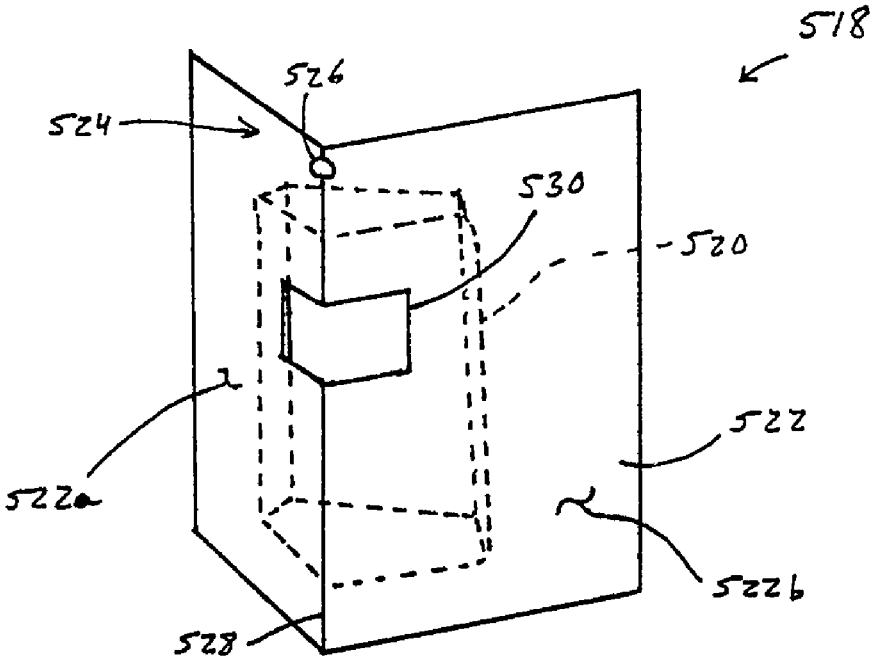
FIG. 7A is a perspective view of another hanging container of the present invention and having a product-container portion in phantom.
Figure 7B:
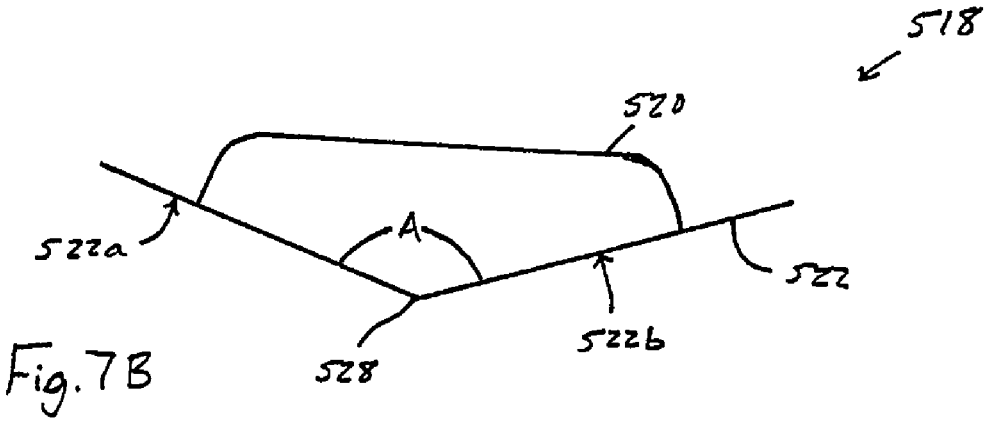
FIG. 7B is a top plan of the hanging container of FIG. 7A.

Optionally, and with reference to FIGS. 7A and 7B, a container 518 includes a product-containing portion or bubble or package portion 520 and a card portion 522 with a header portion 524 that has an aperture or hole or opening 526 therethrough. Card portion 522 has a vertical fold or crease 528 (such as along a centerline of the card portion) so that card portion 522 has two non-coplanar front faces 522*a*, 522*b* that meet at crease 528. Front faces 522*a*, 522*b* may form an angle A (FIG. 7B) at crease 528 of less than 180 degrees. For example, the angle may be at least approximately 90 to 160 degrees. It will be appreciated that angles greater than 180 degrees may also be used, so that the card faces angle forwardly and away from the package portion of the container. Optionally, container 518 may include an aperture or window 530 through card portion 522 at front faces 522*a*, 522*b*, and through which all, or at least a portion, of a product (not shown) may be viewed. Package portion 520 is positioned behind card portion 522 and contains the product so that the combined CG of container 518 and the product is located behind opening 526. Front faces 522*a*, 522*b* are thus tilted upwardly in a similar manner as described above, such that a detailed discussion of the orientation of container 518 when suspended from a rod or projection need not be repeated herein. Thus, when container 518 is suspended from a rod at a pegboard display or the like at an aisle of a retail store, front face 522*a* is angled in one direction, such as toward an end of the aisle at the retail store, and front face 522*b* is angled in another direction, such as toward the opposite end of the aisle. Front faces 522*a*, 522*b* are thus more visible or viewable to a shopper approaching container 518 from either end of an aisle than a container having a single-plane card or face.

Therefore, the present invention provides a display system and method for the displaying product packages or containers that provides for enhanced viewing of a front face of an angled or tilted package or container or box positioned on a support, such as a shelf or rod, relative to conventional, generally vertically oriented containers positioned on the shelf or rod next to the angled containers of the present invention. The angled containers are angled or tilted so as to be directed partially upward to enhance the reflectivity of the light off of the front faces of the containers, in order to enhance or brighten the front faces of the containers for enhanced viewing by a person looking at the containers on the supports. The front faces of the angled containers thus may function to reflect the illumination from the ceiling lights generally toward the eye level of the customers shopping in the store to enhance the brightness and appearance of the angled containers and to make the angled containers stand out from the other conventional packages or boxes on the shelves.

Because the containers are angled partially upward toward the ceiling lights, the containers provide a spotlight effect by reflecting a greater amount of light toward the viewer, such that the faces of the containers appear as though a spotlight is on them and, thus, enhances the viewability of the containers to the customers in the store. Also, the angled containers of the present invention, when positioned on an upper or higher support above a particular level or typical eye level height, may be reversed so as to be angled forwardly and partially downwardly to again enhance viewing of the containers on the upper supports above the person's eye level. The planar variation of the angled or tilted packages helps them stand out from the substantially uniform planes of the other conventional boxes or containers on the supports or shelves. Because the angled containers may stand out from the other packages or boxes on the supports, the present invention may provide for enhanced sales of the products packaged within the angled containers by increasing the likelihood of an impulse purchase by a customer that is walking along the aisles of the stores.

Changes and modifications in the specifically described embodiments may be carried out without departing from the principles of the present invention, which is intended to be limited only by the scope of the appended claims as interpreted according to the principles of patent law.

The embodiments of the invention in which an exclusive property or privilege is claimed are defined as follows:

1. A container for containing a product, wherein said container is configured to suspend from a generally horizontal support arm extending from a generally vertical support surface, said container comprising:

a product-containing portion defining a chamber for containing the product;

a card portion at said product-containing portion, said card portion positioned in front of said product-containing portion and the product and having a front face opposite said product-containing portion and opposite side edges;

a header portion at an upper region of said card portion, said header portion defining an aperture therethrough for receiving the support arm;

at least one wing at one of said opposite side edges of said card portion, said wing having a supported base edge attached at least partially along said one of said opposite side edges of said card portion, and further having a free distal edge opposite said supported base edge, wherein said wing projects from said one of said opposite side edges of said card portion at an angle; and wherein the center of gravity of said container containing the product is located behind said card portion so that said container, when supported from the support arm, is suspended from the support arm in a tilted manner such that said front face is angled to face at least partially upwardly and generally away from the generally vertical support surface.

2. The container of claim 1, wherein said at least one wing projects one of i) forwardly from said card portion at an angle of at least 20 degrees relative to said card portion, and ii) rearwardly from said card portion at an angle of at least 20 degrees relative to said card portion.

3. The container of claim 1, wherein said at least one wing projects one of i) forwardly from said card portion at an angle of about 45 degrees relative to said card portion, ii) rearwardly from said card portion at an angle of about 45 degrees relative to said card portion, iii) forwardly from said card portion at an angle of about 90 degrees relative to said card portion, and iv) rearwardly from said card portion at an angle of about 90 degrees relative to said card portion.

4. The container of claim 1, wherein said at least one wing comprises a wing at each of said opposite side edges of said card portion.

5. The container of claim 1, wherein said product-containing portion comprises at least one of (i) a bubble element, (ii) a shrink-wrap element, (iii) a blister element, and (iv) a box element.

6. The container of claim 1, wherein said card portion comprises a transparent portion configured to permit viewing of at least a portion of the product through said front face.

7. The container of claim 1, wherein said at least one wing comprises text indicative of the product contained therein.

8. A product display system for displaying product containers, said product display system comprising:

at least one support arm extending outwardly from a generally vertical support surface;

at least one illumination source positioned above said at least one support arm and operable to illuminate said support arm;

at least one tilted product container positioned on said support arm, said tilted container comprising a card portion having opposite side edges, at least one wing at one of said opposite side edges of said card portion, said wing having a base edge attached at least partially along said one of said opposite side edges of said card portion, and further having a free distal edge opposite said supported base edge, a product-containing portion, a header portion, and an aperture formed through said header portion, said product-containing portion containing a product positioned substantially entirely to the rear of said card portion with no portion of a product protruding forwardly beyond said front face of said card portion, said tilted product container being supported by said support arm via said support arm inserting through said aperture; and wherein said header portion is positioned in front of the center of gravity of said container when said container is oriented substantially vertically and said container is supported by the support arm in a tilted or non-vertical manner such that a front surface of said card portion is biased upwardly when said container is supported by said header portion at said aperture, and wherein said at least one wing projects from said one of said opposite side edges of said card portion at an angle.

9. The product display system of claim 8, wherein said wing projects one of i) forwardly from said card portion at an angle of at least 20 degrees relative to said card portion, ii) rearwardly from said card portion at an angle of at least 20 degrees relative to said card portion, iii) forwardly from said card portion at an angle of about 90 degrees relative to said card portion and iv) rearwardly from said card portion at an angle of about 90 degrees relative to said card portion.

10. The product display system of claim 8, wherein said at least one wing comprises a wing at each of said opposite side edges of said card portion.

11. The product display system of claim 8, wherein said front face comprises a picture thereon and text indicative of the product contained therein, said tilted container providing enhanced viewability of said picture and said text when said tilted container is supported by the support arm to bias said front face at least somewhat toward said illumination source.

12. The product display system of claim 8, wherein said card portion has a transparent portion configured to permit viewing of the product through said card portion by a person viewing said front face of said card portion, said tilted container providing enhanced viewability of the product to a person viewing said front face of said card portion when said tilted container is supported by the support arm with said front face at least partially angled toward said illumination source.

13. A container for containing a product, wherein said container is configured to suspend from a generally horizontal support arm extending from a generally vertical support surface, said container comprising:

a product-containing portion defining a chamber for containing the product;

a card portion at said product-containing portion, said card portion positioned at least partially in front of said product-containing portion and having opposite side edges;

a header portion at an upper region of said card portion; and a wing at each of said opposite side edges of said card portion, each of said wings having a supported base edge attached at least partially along a respective one of said opposite side edges of said card portion, and further having a free distal edge opposite said supported base edge, wherein each of said wings projects from the respective one of said opposite side edges of said card portion at an angle.

14. The container of claim 13, wherein at least one of said wings projects one of i) forwardly from said card portion at an angle of at least 20 degrees relative to said card portion, and ii) rearwardly from said card portion at an angle of at least 20 degrees relative to said card portion.

15. The container of claim 13, wherein at least one of said wings projects one of i) forwardly from said card portion at an angle of about 45 degrees relative to said card portion, ii) rearwardly from said card portion at an angle of about 45 degrees relative to said card portion, iii) forwardly from said card portion at an angle of about 90 degrees relative to said card portion, and iv) rearwardly from said card portion at an angle of about 90 degrees relative to said card portion.

16. The container of claim 13, wherein said header portion defines an aperture therethrough for receiving the support arm.

17. The container of claim 13, wherein said product-containing portion comprises at least one of (i) a bubble element, (ii) a shrink-wrap element, (iii) a blister element, and (iv) a box element.

18. The container of claim 13, wherein said card portion comprises a transparent portion configured to permit viewing of at least a portion of the product through said card portion.

19. The container of claim 13, wherein at least one of said wings comprises text indicative of the product contained therein.

20. The container of claim 13, wherein said card portion is positioned substantially entirely in front of said product-containing portion and the product, and wherein the center of gravity of said container containing the product is located behind said card portion so that said container, when supported from the support arm, is suspended from the support arm in a tilted manner such that a front face of said card portion is angled to face at least partially upwardly and generally away from the generally vertical support surface.

* * * * *